United States Patent [19]

Brown et al.

[11] 4,020,777

[45] May 3, 1977

[54] VESSEL AND APPARATUS FOR AT-SEA RETRIEVAL OF BUOYS AND ANCHORS

[75] Inventors: Robert W. Brown, New Orleans; Nico deBoer, Kenner, both of La.

[73] Assignee: J. Ray McDermott & Co., Inc., New Orleans, La.

[22] Filed: Jan. 8, 1976

[21] Appl. No.: 647,648

Related U.S. Application Data

[63] Continuation of Ser. No. 497,938, Aug. 16, 1974, abandoned.

[52] U.S. Cl. ..... 114/258; 114/61; 114/293

[51] Int. Cl.[2] ..... B63B 35/44

[58] Field of Search ..... 9/8 R, 9; 114/41, 44, 114/43.5 R, 45, 61, 206 R, 210, 235 R, .5 R; 56/9

[56] References Cited

UNITED STATES PATENTS

| | | | |
|---|---|---|---|
| 3,078,680 | 2/1963 | Wepsala | 114/151 |
| 3,127,865 | 4/1964 | Pleuger | 114/151 |
| 3,498,033 | 3/1970 | Huff | 56/9 |
| 3,507,241 | 4/1970 | Southerland, Jr. et al. | 114/43.5 |
| 3,631,829 | 1/1972 | Kamph | 114/43.5 |
| 3,815,541 | 6/1974 | Hansen | 114/43.5 |

FOREIGN PATENTS OR APPLICATIONS

| | | | |
|---|---|---|---|
| 1,302,386 | 1/1973 | United Kingdom | 114/.5 RC |

*Primary Examiner*—Trygve M. Blix
*Assistant Examiner*—Jesus D. Sotelo
*Attorney, Agent, or Firm*—Arnold, White & Durkee

[57] ABSTRACT

An at-sea buoy and anchor retrieval apparatus utilizes a vessel having a catamaran hull with a buoy catcher apparatus disposed between the hulls of the vessel. The buoy catcher is vertically movable so that it can be placed at the appropriate water depth to capture the buoys when the vessel is underway. A lift is provided to elevate the buoy catcher containing the buoy to the vicinity of an opening in the deck so that access to the buoy may be had from the deck.

11 Claims, 9 Drawing Figures

FIG. 2
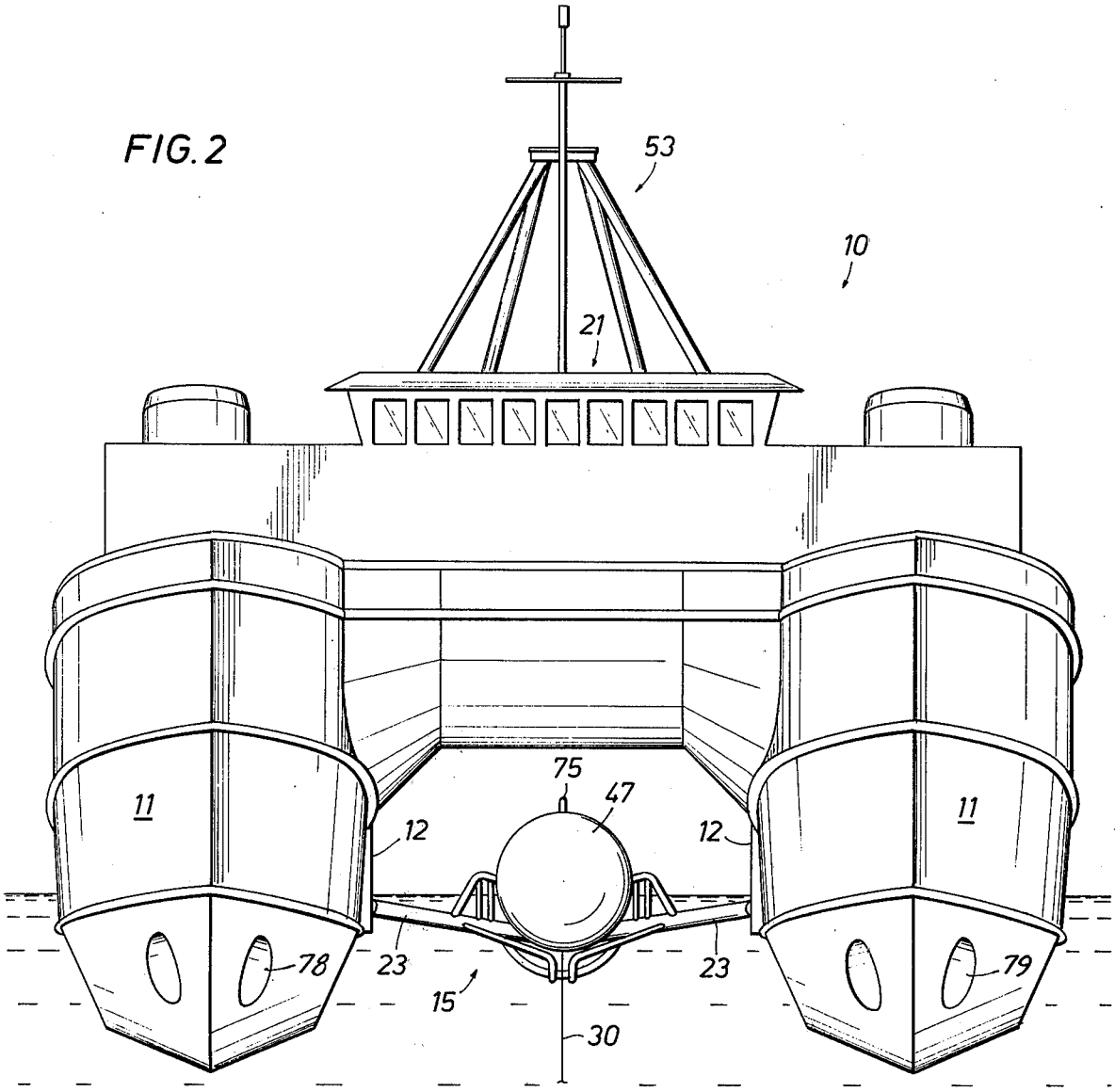
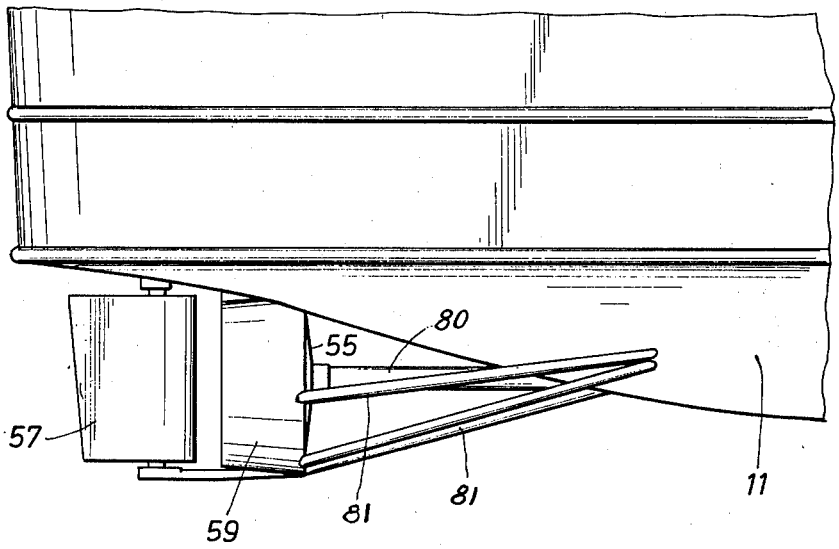
FIG. 3

VESSEL AND APPARATUS FOR AT-SEA RETRIEVAL OF BUOYS AND ANCHORS

This is a continuation of application Ser. No. 497,938, filed Aug. 16, 1974, now abandoned.

BACKGROUND OF THE INVENTION

The present invention relates to an apparatus used in the at-sea retrieval of floating objects such as anchor buoys and seismic buoys. The apparatus of this invention may be used for the purpose of picking up any floating object at sea, such as a buoy, in order to retrieve or reposition a subsea article such as an anchor attached to the buoy, or more simply to retrieve and collect free floating objects.

Anchor buoys are employed, for example to mark the anchors of a pipelaying barge which utilizes the anchors to position itself and maintain itself on course for example, during a pipelaying operation. As the barge lays pipe it becomes periodically necessary to reposition the anchors of the lay barge. This is accomplished by picking up the anchors via cables or other pendent lines attached to the anchor and run through buoys floating on the surface. Pneumatic buoys having a central hawsepipe through which the cable or pendent line passes are commonly used. The anchors are then repositioned with the buoys again marking the new position of the anchors.

In an at-sea pick-up operation of any floating object, the task becomes progressively more difficult as sea conditions worsen. The pick-up is potentially hazardous where personnel are required to be near the rail of an ocean-going vessel while assisting in the retrieval operation. One method to retrieve buoys involves use of an over-the-side capture apparatus utilizing a boom and/or winch to capture the buoy and reposition the anchor. Such an arrangement present difficulty in maneuvering the vessel into position. Since steerage is particularly difficult in a high sea, the efficiency of such an apparatus is markedly reduced when most needed. There is an additional disadvantage to this method caused by the parallax effect of the retrieval apparatus being offset from the centerline of the vessel. Thus the exact placement of the retrieval apparatus is rendered more difficult by having to visually ascertain the track of the vessel and the offset track of such apparatus while allowing for wind and water action.

Another method used is simply for a crew member to physically place a hook on the floating object and then to retrieve the object with a boom and or winch apparatus. This method necessarily involves increased difficulty for crew members and becomes increasingly hazardous and difficult with increasing wave intensity.

SUMMARY OF THE INVENTION

There is provided with this invention, a novel means for retrieval operations of floating objects at sea, particularly anchor buoys.

Further, the apparatus of this invention will increase the efficiency of personnel-vessel combinations by reducing the number of personnel required in the retrieval operation. This result is accomplished by providing a novel apparatus for retrieving floating objects with minimum requirement for manual handling until after the object is secured in the mechanical apparatus of the retrieval mechanism.

This invention is related to apparatus for retrieving objects at sea with a catamaran vessel and self-contained mechanical retrieval apparatus designed to pick up such floating objects. Desirably, the catamaran vessel would be a sea-going design to allow it to operate in adverse weather conditions and high seas, in order to gain the advantage of being able to operate on more days in a given time period. The catamaran, or twin-hull design, has unique advantages over a conventional hull design and is of particular significance in this invention. This design is important in that the pick-up apparatus of the invention can be located between the hulls in a relatively protected area, with such location being optimum in buoy retrieval.

In accordance with this invention, apparatus for at-sea buoy retrieval is provided which comprises a catamaran vessel having an adjustable retrieval apparatus disposed centrally between the hulls and having the capability of capturing and holding a floating object at water level and raising the object to deck level in order to facilitate its retrieval. The adjustability of the retrieval apparatus enables it to be positioned at varying depths between the hulls in order to permit its use with buoys of various draft and configuration and further to permit its use under varying conditions of draft of the vessel dependent upon the amount of cargo or fuel being carried by the vessel.

The retrieval apparatus is preferably arranged symmetrically between the catamaran hulls and desirably comprises a structure having a relatively open framework in order to minimize drag when it is in the water in a retrieval position. Suitable tubular or stut-like members are used to construct the retrieval apparatus.

Once the proper vertical adjustments of the retrieval apparatus are made to position the apparatus at the proper water depth to catch the buoy, the vessel approaches the buoy for pick-up. Since the pick-up apparatus is disposed about the centerline of the vessel, it is only necessary to align the object directly with such centerline for it to be properly oriented for pick-up.

It will also be apparent to those skilled in the art, that last-second steerage corrections may be necessary when attempting to maneuver a vessel of this size along a finite path through the water. Conventional steerage means, comprising rudders attached to the aft portion of each hull, do not affect the track of the vessel rapidly enough to make immediate direction changes particularly at low vessel speeds. In order to alleviate this problem and in accordance with a further aspect of this invention, the vessel is provided with bow thrusting means, which can impart a force to the front of the vessel, normal to the direction of travel. Thus, the track of the vessel can be immediately affected with the desired last-second steerage corrections being accomplished.

Accordingly the invention involves apparatus for capturing a floating object at sea comprising a catamaran vessel having a retrieval apparatus mounted between the hulls, the retrieval apparatus including a retainer means to hold the buoy within the apparatus. The retrieval apparatus is movable in a vertical direction relative to the waterline of the vessel to permit the retainer means to be positioned at the desired level relative to the waterline of the vessel to capture the floating object and also to position the retainer means containing a captured object proximate the deck to permit access and retrieval by personnel on the deck. An opening in the deck above the retainer means provides this access. A suitable lifting means such as a crane or the like, on the deck can be used to lift the captured object onto the deck. More typically, in repositioning anchors, the buoy is captured and raised to deck level where the anchor pendent line which passes centrally through the buoy may be affixed to a winch or crane to lift and reposition the anchor.

The retrieval apparatus is preferably affixed to the inboard surfaces of the opposing hulls and includes guide members forward of the retainer means to direct the floating object into the retainer means, or buoy cradle. In the illustrated and preferred embodiment, the forward end of the guide members are pivotally mounted within vertical tracks on the opposing hulls, and a lift means is provided on the aft portion of the retrieval apparatus to elevate the retainer means or buoy cradle to proximity of the deck and to position the aft portion out of the water when the vessel is underway and retrieval operations are not being conducted.

One preferred use of the apparatus of this invention is in retrieval of anchor buoys in a lay barge anchor repositioning operation. The apparatus could also be used to retrieve buoys marking the termination of an underwater pipeline on which work has been temporarily suspended.

Although the preferred embodiment of this invention will be described in relation to retrieval of anchor buoys, it will be easily seen that this apparatus could be adapted for retrieval of any floating object at sea, or retrieving or repositioning a subsea apparatus or article marked by a floating object. Various further modifications of the device described for such purposes will be readily recognizable to those skilled in the art.

BRIEF DESCRIPTION OF THE DRAWINGS

The above and other objects and features of the invention reside in the details of construction of the apparatus which become more easily understood by references to the following figures in which:

FIG. 2 is a frontal view of the catamaran tugboat and retrieval apparatus, showing bow thrusters on the frontal portion of each of the twin hulls.

FIG. 3 is a side view of the wheel guard apparatus.

DETAILED DESCRIPTION OF THE INVENTION

Figure 1:
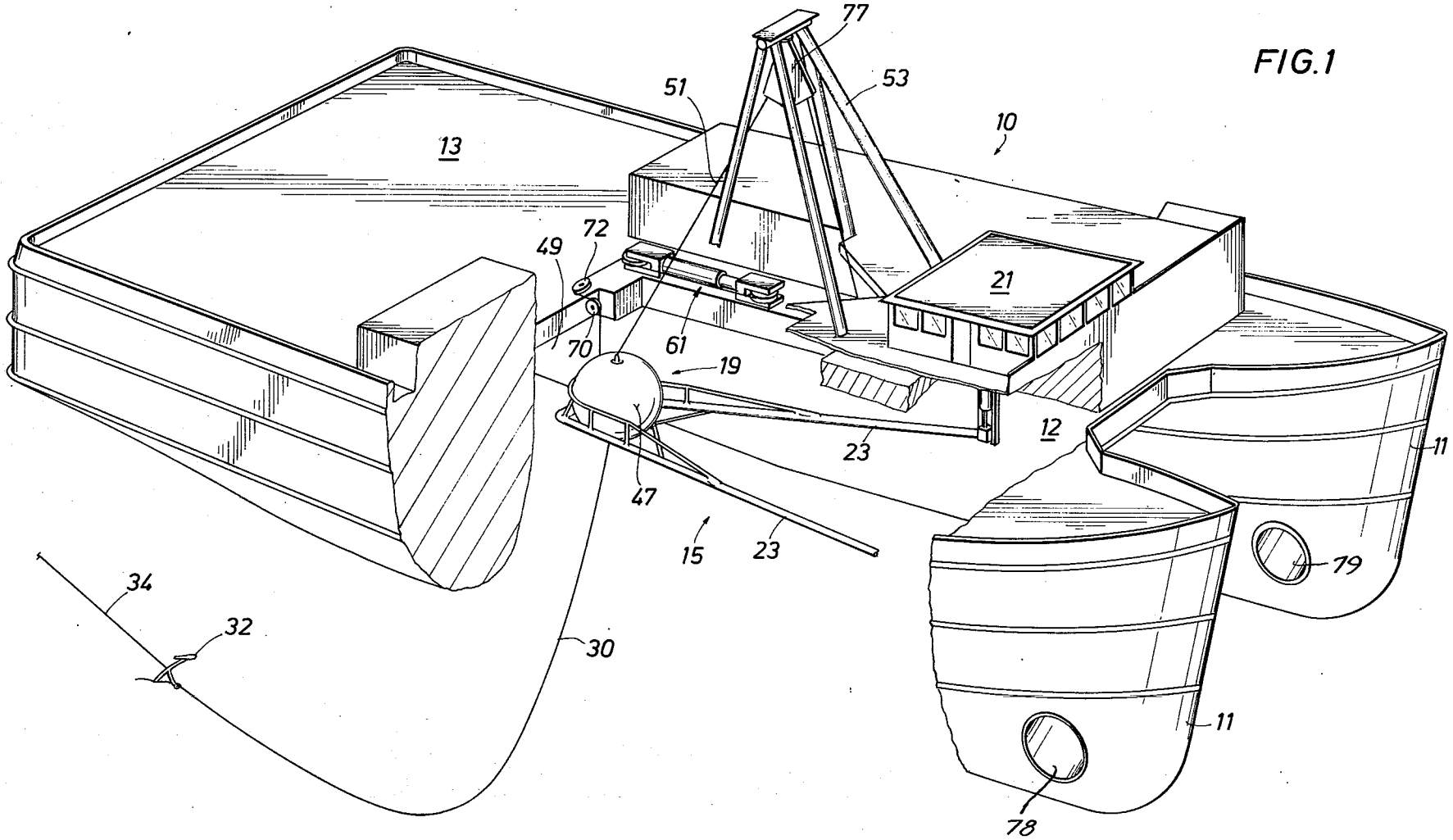
FIG. 1 is a perspective view of the catamaran tugboat, with a portion thereof cut away to show the retrieval mechanism located in the approximate center of the vessel.

Referring to FIG. 1, there is shown a vessel 10 which represents an embodiment of the instant invention. The vessel comprises catamaran hulls 11, deck 13, and associated superstructure.

The retrieval apparatus is generally shown at 15. The retrieval apparatus comprises main support bars 23, and the buoy retainer means or cradle 19 which catches and supports the buoy. The retrieval apparatus 15 is disposed between the catamaran hulls 11 and is affixed to the inboard surfaces 12 of the hulls so as to be generally symmetrically arranged about the centerline of the vessel as may be seen in FIG. 2. The advantage of this feature becomes more readily apparent when considering operation of the tugboat in rough seas or fading light. The pilot house 21 and a steerage control console (not shown) are located in proximity to said centerline. Thus, the alignment of the retrieval apparatus 15 along the path of approach to a floating object is greatly facilitated by the fact that the apparatus is not offset from the centerline of the path of travel of the vessel. It is only necessary for the operator of the tugboat to orient his path of travel directly toward the desired object, and said object will be properly situated in relation to the retrieval apparatus so as to be guided into the proximity of said apparatus for capture.

As the vessel approaches a buoy and passes over it, the two guide support bars 23 which are angled toward the center-line of the vessel will generally tend to centralize the buoy between the hulls and direct it toward cradle 19. It may be desirable, depending upon buoy design, to provide a number of guide support bars in an arrangement somewhat parallel to those shown at 23 to insure the buoy is directed to cradle 19. Cradle 19, as shown is designed for catching a spherical anchor buoy 47 of the type having a central cable which is connected to the subsea anchor. Typically such buoys are pneumatic and are constructed of rubber or like flexible material. The anchor pendent line 30 passes centrally through the buoy and terminates atop the buoy in an eye 75 or similar fixture to which connection may be readily made to retrieve the anchor 32. An anchor cable 34 extends to the barge secured by the anchor. It will be appreciated that various configurations of cradle 19 could be adapted to different retrieval buoys of other shapes or types.

Figure 4:
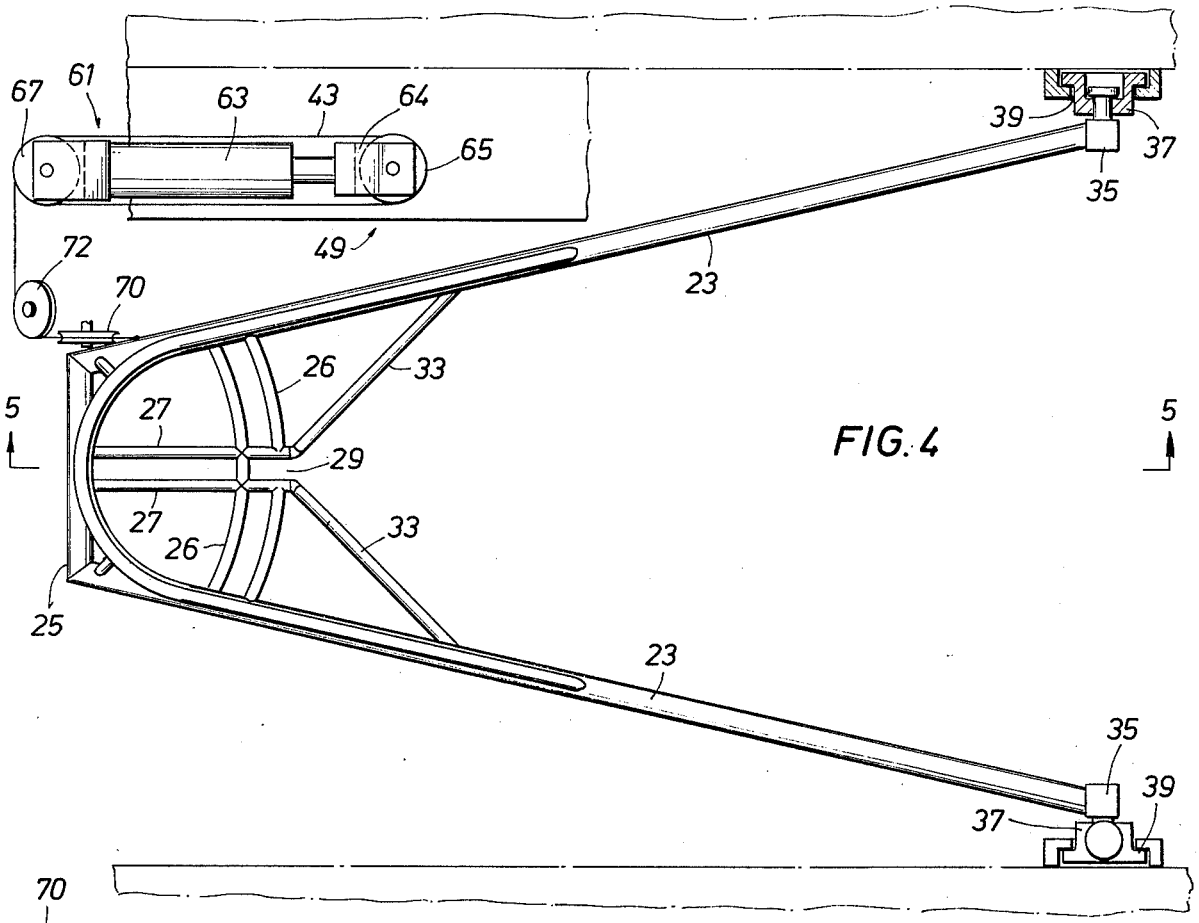
FIG. 4 is a top view of the buoy catcher retrieval apparatus.
Figure 5:
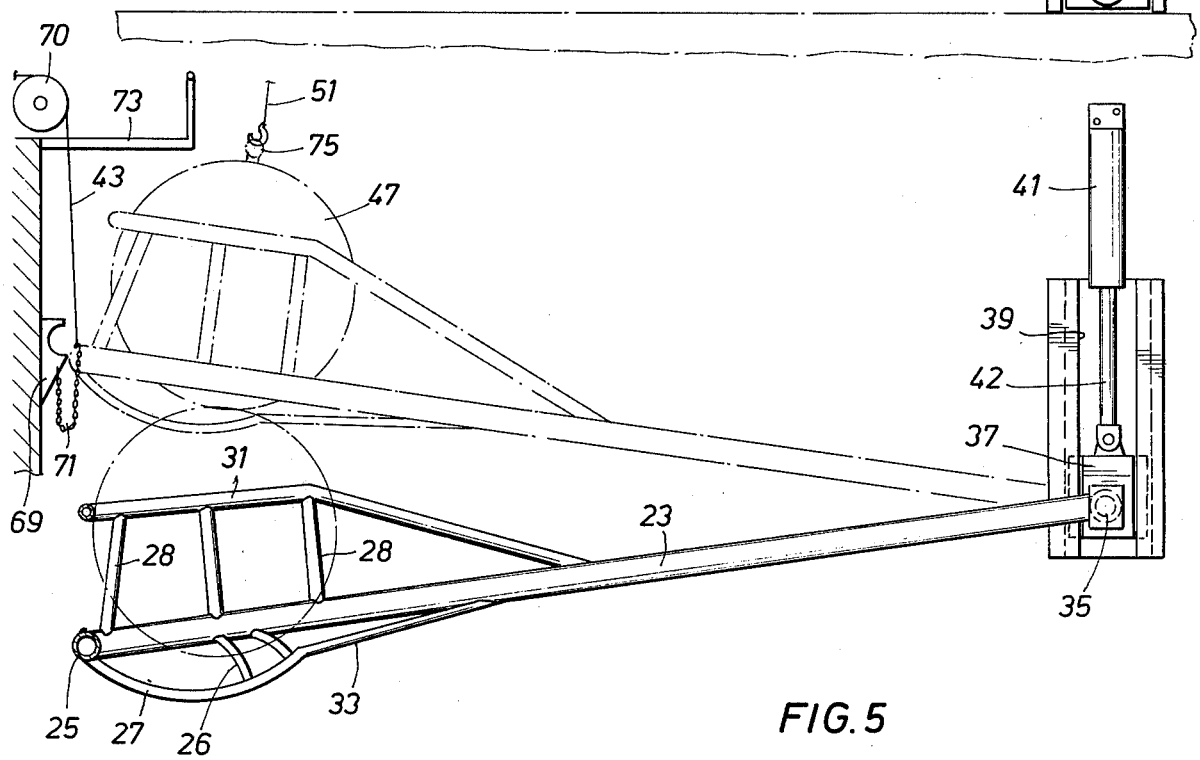
FIG. 5 is a side view of the retrieval mechanism in two positions with the shaded outline of a buoy or other retrieved object in its captured position and showing a detail of the structure mounting the retrieval apparatus to the inboard hull surface.

Referring to FIGS. 4 and 5, there is shown respectively a top view and a side view of the retrieval apparatus, which could also be referred to as a buoy catcher, as well as means for positioning the retrieval apparatus relative to the waterline of the vessel. FIG. 5 is taken along section line 5—5 of FIG. 4.

Support guide bars 23 angle inwardly from the inboard hull surfaces of the vessel, and are joined to form a generally U-shaped structure. As shown, a rear support bar 25 connects the two support guide bars. Lower cradle bars 26 and 27 are suspended from the support guide bars and define a slot 29 which will accommodate a cable affixed to the buoy when the buoy is in position in the cradle. Upper retaining bars 31 are also supported from support guide bars 23 and provide a barrier or fence holding the buoy in the cradle while the vessel is underway. Centering bars 33 perform the final directing function to insure that the buoy is directed properly into the cradle. As indicated above, support guide bars 23 function as the initial directing means for the buoy or other floating object to be retrieved. The more sharply angled centering bars 33 perform the final function of centralizing the cable below the buoy in directing the buoy into the cradle formed by the upper retaining bars 31 and lower cradle bars 26 and 27. Once in position, the buoy will rest in the cradle 19 and will be firmly maintained in position. Water moving relative to the buoy resulting from vessel movement tends to force the buoy firmly against the rear portion of the cradle 19 and upper retaining bars 31. Accordingly, the upper retaining bars 31 should be sufficiently high that water movement will not propel the buoy up and out of the cradle once it has been positioned in the cradle.

It should be noted that the cradle contains no restriction to raising the buoy in a vertically upward direction. It will be apparent to those skilled in the art that cradle design and the elevation of the support guide bars relative to water level may depend upon the particular configuration of the buoys or other objects to be captured. The cradle should be so designed that the buoy will be firmly held in place without damage by the relative movement of water and yet can be easily and readily raised vertically from the cradle. As shown in FIG. 5 and dotted outline, a spherical buoy is shown within the cradle with the upper retaining bars 31 restraining any rearward movement of the buoy out of the cradle.

It should also be noted that the retrieval apparatus and cradle are preferably of an open truss network design. Thus, for example, upper retaining bar 31 is supported by support members 28 in order that the entire retrieval apparatus present minimum drag to the vessel when the vessel is underway.

The forward end of each of the support guide bars 23 terminates in a pivot block 35. Pivot block 35 is pivotally mounted with respect to carriage member 37 which in turn is disposed for vertical movement within tracks 39 which are secured to the inboard hull surface 12. A hydraulic cylinder 41 is connected to carriage member 37 by a connecting rod 42. Accordingly, carriage member 37 can be positioned at any desired place along track 39. It will be appreciated that other suitable means to position the forward end of the guide support bars 23 at varying elevations with respect to the waterline of the vessel could also be used. For example, a cable and winch arrangement could be used in place of hydraulic cylinder 41. Alternatively, carriage member 37 might be connected to a vertically disposed screw, enabling vertical positioning of the carriage member by rotating the screw into a support member utilizing a hydraulic motor or electric motor or the like. Likewise any suitable track arrangement which disposes a carriage member such as 37 for vertical movement along the inboard surfaces of the opposing catamaran hulls may be used.

Figure 6A:
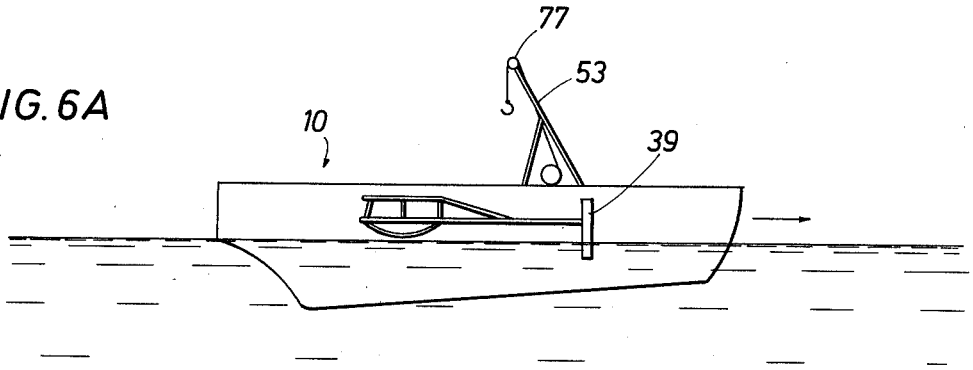
FIGS. 6A through 6D are schematic representations of the apparatus of this invention illustrating a sequence which may be used in retrieving an anchor buoy and repositioning an anchor.

By activating hydraulic cylinder 41, the forward end of guide support bars 23 can be positioned at any desired level relative to the waterline. Thus, when the vessel is not being used for capture of floating objects or buoys, the guide bars can be positioned out of the water as shown in FIG. 6A in order to minimize drag. Similarly, depending upon buoy design or depending upon the wave action of the seas, the forward end of the support guide bars 23 may be positioned at various heights relative to the waterline in order to assure that the guide bars function efficiently to direct the buoys toward the cradle 19.

The aft portion of the retrieval apparatus is connected by cable 43 to hoist 61, shown in FIG. 4 on the port side of deck opening 49. A similar hoist may be located on the starboard side of opening 49. Opening 49 in deck 13 is directly above the cradle 19 of the buoy catcher to enable access to the buoy or other object within the cradle from deck 13. Hoise 61 enables the aft portion of the buoy catcher to be raised to the proximity of the deck, pivoting the forward ends of support bars 23 in pivot blocks 35.

Any suitable lifting mechanism may be used to perform the function of hoist 61. For example, hydraulic cylinders or a suitable winch and cable arrangement might be employed. Illustrated hoist 61 includes a hydraulic cylinder 63 having movable head 64. The hydraulic cylinder and movable head mount two sets of sheaves 65 and 67 to form a drawworks around which cable 43 may be wound a suitable number of times to obtain a desired lifting advantage. For example, if cable 43 is wound around the sheaves 65 and 67 six times, one foot of travel of sheave 67 in the direction of the arrow will result in six feet of lift to the buoy catcher. The cable then passes over directly sheaves 70 and 72 to retrieval apparatus 15. Thus, the illustrated hoist provides a convenient mechanism to raise the buoy catcher a prescribed amount so that the captured object will be at the desired height in opening 49. Hoist 61 also thereby enables proper positioning of the cradle at a desired height relative to the waterline during buoy catching operations. It also enables the aft portion of the retrieval apparatus and the cradle to be lifted clear of the water when buoy catching operations are not being conducted.

Figure 6B:
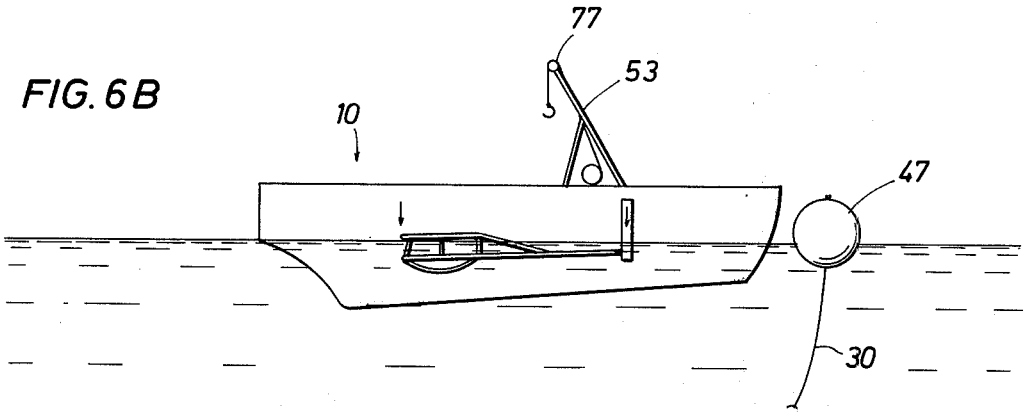

Thus, when buoy catching is not underway, the carriage member 37 is lifted high in track 39 and the drawworks of hoist 61 extended to position the retrieval apparatus entirely out of the water as shown in FIG. 6A. When carriage member 37 is lifted, rear support bar 25 is positioned in rest 69 which supports the aft portion of the retrieval apparatus. A safety chain 71 may also be desirably provided. During buoy catching operations, the carriage members 37 would be first positioned at an efficient elevation to assure directing of the buoys to cradle 19. Hoist 61 would then be adjusted to provide an appropriate elevation to the rearward section of the retrieval apparatus and the cradle thus positioning the retrieval apparatus as shown in FIG. 6B. When a buoy or other floating object has been overrun by the vessel and is firmly within the cradle, the hoist would be activated and the rearward portion of the retrieval apparatus could be elevated so that the upper portion of the buoy (shown at 47 in FIG. 1) would be proximate the deck 13 of the vessel. The opening 49 in the deck of the vessel approximately above the position of the buoy in the retrieval apparatus enables access to the buoy from the deck.

It is desirable for a suitable catwalk 73 (in FIG. 5) to be positioned over the rear portion of opening 49 in order that a crewman might have ready access to the top of the buoy when in the elevated position.

After buoy 47 has been elevated into opening 49 in order to provide access to the buoy by a crewman, the eye 75 atop buoy pendent line 30 can be suitably secured to a cable 51 suspended from crane 53. The captured object may then be elevated onto the deck or alternatively the anchor pendent line 30 may be suitably engaged in crane 53 in order to lift the anchor from the bottom and to reposition it. Crane 53 is provided with a suitable winch (now shown) in order to provide a lifting capability to the crane.

In accordance with such operation, the buoy catching operation can be readily accomplished without repositioning the forward end of the guide support bars 23. During buoy retrieval operations, therefore, it is only required that the retrieval apparatus and cradle 19 be lifted to the proximity of opening 49 in order to enable a crewman to affix the cable of crane 53 to the buoy anchor pendent line 30. Upon retrieval of one buoy, the cradle can simply be lowered without repositioning the forward end of the guide support bars.

Figure 6C:
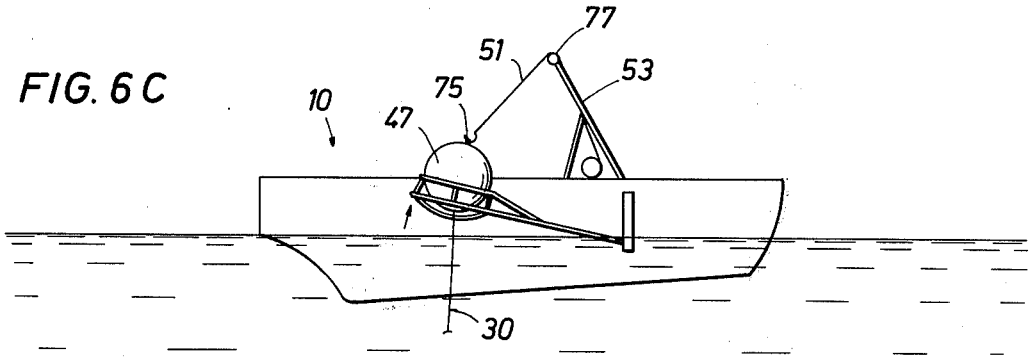
Figure 6D:
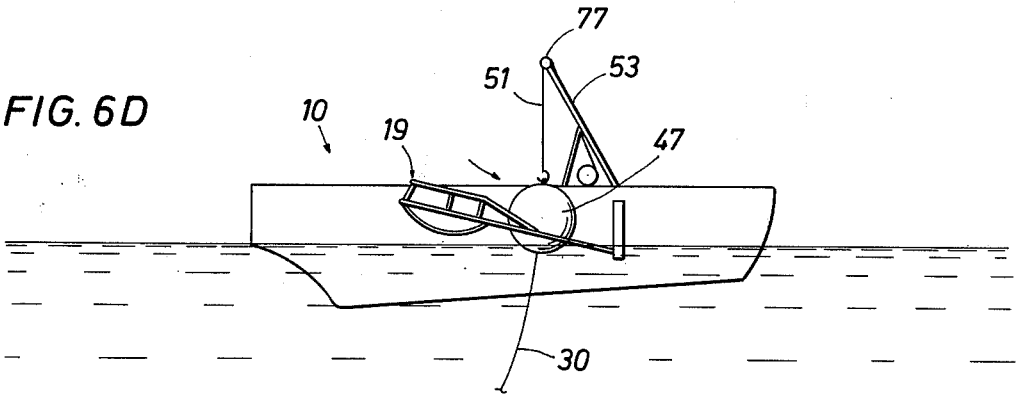

In anchor repositioning operations, it is typical that the pendent line merely passes through a central opening in the buoy terminating an eye 75 atop the buoy. In these instances, it is desirable to reposition the anchor without raising the buoy on deck. Thus, desirably the crown block 77 of crane 53 is desirably located forward of the position of the buoy within cradle 19 as shown in FIG. 6C. When the eye of the pendent line is fastened to the cable and lifting is begun, the pendent line will tend to fall vertically from crown block 77 thus, displacing the buoy out of cradle 19. The buoy then simply slides down the pendent line 30 to the water as in FIG. 6D and the repositioning of the anchor proceeds by raising the pendent line through the buoy. When repositioning is complete, the pendent line is paid out from crane 53 and the retrieval mechanism is raised to permit the vessel to overrun the buoy and proceed to the next catching operation.

It will be readily appreciated that alternative apparatus could be used in the place of that described in order to position and lift the retrieval apparatus. For example, the aft portion of the retrieval apparatus could be similarily affixed to the inboard hull surfaces opposite the position of the cradle 19 and provided with hydraulic cylinders which would be capable of positioning the aft portion of the retrieval apparatus at the desired elevation, and would be further capable of elevating the cradle into proximity with opening 49 in deck 13 in order that access to the buoy might be had by a crewman. Indeed, the entire retrieval apparatus might be mounted in tracks at positions on the inboard surfaces of the hulls approximately midway of the retrieval apparatus. Suitable means could then be provided to position the retrieval apparatus at any desired elevation relative to the waterline and further to elevate the retrieval apparatus in its entirety in order that access to a captured buoy or other floating object might be had through opening 49 in the deck.

As stated above, the guide system as illustrated comprises primarily guide support bars 23 and centering bars 33. Depending upon buoy configuration it may be desirable and necessary to provide additional guide members to insure that the vessel will not overrun the buoy without capturing it in cradle 19. It will be noted that the anchor buoy 47 which are illustrated are of a rubber construction and hence would not be expected to be damaged by striking the hull of the vessel at a point forward of the retrieval apparatus. Buoys constructed of metal or the like might damage the vessel if striking any portion of the hull, and under such circumstances, a more extensive guide system, including guide members extending as far forward as the bow, might be required in order to avoid damage to the vessel and to the buoy by virtue of such collision.

In FIG. 3 there is illustrated a further precaution which is desirable in construction of a buoy catching vessel of the type described. FIG. 3 illustrates a standard propeller propulsion system at the stern of each hull 11 of the catamaran vessel. Propeller 55 is mounted on rotating shaft 80 which provides power. Immediately aft of the propeller is a standard type rudder 57. However, in view of the possibility that despite precautions with respect to design of the retrieval apparatus, that a buoy might be overrun by the retrieval apparatus, it is desirable to provide a propeller guard 59 as well as suitable propeller guide bars 81 at least on the inboard side but desirably on both inboard and outboard sides of each propeller mounted in the stern of hulls 11 to avoid the buoy or other objects striking the propellers.

Referring to FIG. 2 it will also be seen that, in accordance with a preferred design, each hull of the catamaran vessel is provided with bow thrusters in each hull in order to enable the vessel to make rapid corrections to its course in approaching a buoy or other floating object for pickup. In heavy seas, it may be necessary to make corrections in course to avoid frontal collision with a buoy. When the vessel in underway, steering corrections by means of rudder 57 might not be sufficiently rapid particularly at low speeds. In the illustrated embodiment bow thrusters, illustrated at 78 and 79 respectively, in the forward portion of each are provided a through-the-hull bow thruster comprising essentially a powered propeller in an opening from the inboard to outboard surfaces of each hull can be used. It will be understood that the remainder of the vessel design illustrated can be standard vessel design and is herein illustrated but not described in detail. It will be further understood that alternative vessel designs may be used. For example, pilot house 21 of the vessel might be positioned further aft, thereby enlarging the opening between the forward portion of each of the hulls. The retrieval apparatus might then be positioned in this forward position between the hulls in order that the pilot house might have a view of the buoy as it is being captured and retrieved. Alternatively, a U-shaped opening may be provided between the hulls in the aft portion of the vessel and the retrieval system positioned below this opening. Other alternatives in the embodiment illustrated will be apparent to those skilled in the art.

What is claimed is:

1. Apparatus for capture of a floating object which comprises:

a powered catamaran vessel having two spaced hulls, said vessel being suitable for maneuverable advancement through a body of water toward an object floating at the surface of the water; and retrieval apparatus disposed between said hulls for capturing and holding the object within said apparatus while said vessel is underway comprising a cradle that provides support to the underside of the object and unrestricted access to the object from above, and guide members which extend forwardly and outwardly of said cradle to direct the object away from said hulls and into said cradle;

said retrieval apparatus being secured to the inboard surface of said hulls, and being movable in a vertical direction to a position below water level to permit capture of the object while said vessel is underway and to a position completely above the water level to alternatively permit said object to be raised out of the water or permit said vessel to overrun the floating object.

2. The apparatus of claim 1, wherein said retrieval apparatus is movable from a first lower position proximate the vessel waterline to enable it to receive a floating object into said cradle to a second position proximate the level of a deck, to permit access to an object in said cradle from said deck.

3. The apparatus of claim 2, wherein said cradle is positioned between said hulls and wherein said deck defines an opening proximate said cradle when in said second position.

4. The apparatus of claim 1, including in combination: bow thruster steering means in the forward portions of each of said hulls.

5. Apparatus for capture of a floating object at sea which comprises:

a catamaran vessel having two spaced hulls and an interconnecting superstructure including a deck defining an opening above the area between the hulls; and retrieval apparatus disposed between the hulls having a cradle to retain the object having an open truss network construction including lower cradle bars for supporting the object from underneath and upper retaining bars for holding the object in the cradle while the vessel is underway and providing unrestricted access to the object from above; and guide means extending forward of said cradle to direct a floating object to a central location between the hulls and into said cradle; said guide means being secured at their forward ends to the inboard surface of the hulls to enable said cradle to move vertically relative to the waterline of the vessel from a lower position proximate the waterline to capture a floating object to an elevated position to alternatively permit the object to be held above the water between the hulls proximate the opening in the deck or to be overrun by the vessel.

6. The apparatus of claim 5, wherein said retrieval apparatus including said cradle is comprised of an open network of trusslike members to minimize drag when the vessel is underway.

7. The apparatus of claim 5, including:

bow thruster means provided int the forward portion of each of said hulls.

8. Apparatus for capture of a floting object at sea which comprises:

a catamaran vessel having two spaced hulls and an interconnecting superstructure including a deck defining an opening above the area between said hulls; and retrieval apparatus disposed between the hulls having holding means to retain a floating object with said apparatus;

said retrieval apparatus being movable in a vertical direction with respect to the waterline of the vessel from a first lower position proximate said waterline to enable said apparatus to receive the floating object to a second position proximate said opening to provide access to the object in said holding apparatus from said deck, and said retrieval apparatus being pivotally secured to the inboard opposing surfaces of said hulls at points forward of said holding means and including:

means to move said pivot points vertically relative to the waterline of said vessel to position said retrieval apparatus relative to said waterline and a hoist to move said holding means in a vertical direction relative to said waterline about said pivot points.

9. The apparatus of claim 8, wherein said retrieval apparatus comprises:

guide members extending forward of said holding means for directing a floating object to said holding means when said vessel is underway;

the forward portions of said guide members being secured to said pivot points; and vertical guide tracks disposed in said opposing hulls including means for positioning the pivot points of said guide members at preselected levels relative to said waterline.

10. The apparatus of claim 9 including:

lifting means on the deck of said vessel for securing and lifting an object held within the holding means of said retrieval apparatus.

11. The apparatus of claim 10 wherein said lifting means includes a crane and cable, said cable being extendable to a captured object in said holding means from a point above and forward of said holding means.

* * * * *